United States Patent [19]

Lahti et al.

[11] Patent Number: 4,786,048

[45] Date of Patent: Nov. 22, 1988

[54] NOVELTY ITEM

[76] Inventors: Johan L. Lahti, Box 249, Asquith, Saskatchewan, Canada, S0K 0J0; Lawrance Michayluik, #317c-207 Tait Place, Saskatoon, Saskatchewan, Canada, S7H 5L8

[21] Appl. No.: 856,194

[22] Filed: Apr. 28, 1986

[51] Int. Cl.[4] ..... A63J 23/00; G09F 19/08; A63H 33/26

[52] U.S. Cl. ..... 272/27 N; 40/411; 446/485

[58] Field of Search ..... 40/411, 416, 447, 448; 49/29; 272/8 D, 8 N, 27 N; 446/483, 484, 485; 434/168, 169, 258

[56] References Cited

U.S. PATENT DOCUMENTS 2,169,266 11/1937 Matter ..... 273/138 A
3,243,914 8/1965 Poynter ..... 272/8 N
4,306,716 12/1981 James et al. ..... 273/1 E
4,324,059 4/1982 Baum ..... 40/416

*Primary Examiner*—Robert A. Hafer
*Assistant Examiner*—Michael Brown
*Attorney, Agent, or Firm*—Stanley G. Ade; Adrian D. Battison; Murray E. Thrift

[57] ABSTRACT

A box with a lid is provided with the lid having spring hinges normally urging the lid closed. A battery operated control unit is situated within the box operatively connected to a display screen at the front of the box which is visible when the lid is open a predetermined amount by a solenoid. The control unit includes an adjustable timer which opens the lid at random intervals to display the screen. The control unit also projects a pair of circles of light on the screen simulating a pair of eyes which move on the screen in a predetermined pattern after which the lid closes with a snapping sound. Normally the screen is black but colors may be introduced either into the screen or the simulated eyes as desired.

9 Claims, 1 Drawing Sheet

NOVELTY ITEM

BACKGROUND OF THE INVENTION

This invention relates to new and useful improvements in novelty items, and is designed primarily to entertain and to stimulate the imagination of the viewer.

Prior art known to applicant includes U.S. Pat. No. 3,243,914 which shows an enclosure with a lid which opens allowing a hand to deposit a coin within the container.

U.S. Pat. No. 2,670,568 shows eyes for a doll which move mechanically and is exemplary of many such mechanical actions for the movement of dolls eyes.

The present invention is designed to provide an enclosure having a lid or cover hinged to the rear side of the enclosure which opens at random intervals, exposing a planar display screen upon which appear a pair of simulated eyes and these eyes move from side to side or up and down for a predetermined time as if viewing the room, after which the lid snaps shut.

The opening and closing intervals are random within predetermined limits and the simulated eye movements may be set by the operator from a preset plurality of movements programmed into the controlled unit. The device utilized current integrated circuit technology well known to those skilled in the electronics field.

One aspect of the invention is to provide an enclosure, and a cover component hinged by one side thereof to the rear side of said enclosure, a source of electrical power in said enclosure, and an electronic control unit within said enclosure operatively connected selectively to said source of electrical power, a display screen in said enclosure for displaying images thereon, and being operatively connected to said control unit, said display unit being situated adjacent the front side of said enclosure and extending into said cover component when same is in the closed position but being visible form the front of said enclosure when said cover component is in the open position, said images comprising a pair of spaced apart illuminated circles simulating a pair of eyes, and moveable across said screen in a predetermined pattern selected by said control unit, and means operatively connected to said control unit to open and close said cover component.

Another advantage of the invention is the snapping action caused when the lid snaps shut thus drawing the attention of the occupants of the room to the fact that the device has operated and raising anticipation as to when the next "viewing" may take place.

The device may be battery or direct power operated and means are provided to switch the device off and on and also to control, within limits, in a random fashion, the timing of the opening and closing of the lid and hence the operation of the device.

A further advantage of the invention is to provide device which is simple in construction, economical in manufacture and otherwise well suited to the purpose of which is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 3:
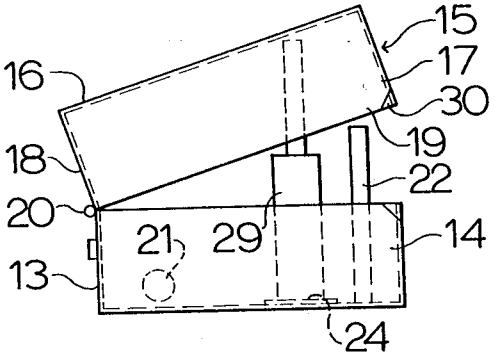
FIG. 3 is an end elevation of FIG. 1 showing the cover component in the open position.

Proceeding therefore to describe the invention in detail, reference character 10 illustrates an enclosure preferably made from synthetic plastic and including a base 11, a front wall 12, a rear wall 13, and end walls 14 all defining a substantially cubical open topped container or enclosure.

A cover component collectively designated 15 is also provided and comprises an upper panel 16, a front wall 17, a rear wall 18 and end walls 19 all of which define a substantially cubical open based cover component matching in dimensions, the enclosure 10. The cover component 15 is hinged to the enclosure 10 by means of hinges 20 secured adjacent the upper side of the rear panel 13 of the enclosure and the lower edge of the rear panel 18 of the cover components as clearly shown in FIG. 3.

A source of electrical energy in the form of storage batteries 21 may be mounted within the enclosure adjacent the rear panel 13 thereof or, alternatively, the device may be operated by main powers with suitable voltage reduction means being provided. Such means are well known and it is not believed necessary to describe same further.

A display screen 22 such as an LED screen is mounted adjacent the front wall 11 of the enclosure and extends upwardly therefrom above the upper edge 23 and is contained within the cover component 15 when the cover component is in the closed position.

A central processing unit or the like shown schematically by reference character 24 is provided within the enclosure and is operatively connected between the LED screen 22 and the source of power 21 with switch means 25 connecting and disconnecting the power means from the control unit 24. A further switch 26 is also provided to vary the time delay of the operation of the device as will hereinafter be described and also, in the preferred embodiment, to select from a predetermined series of patterns, the actual display appearing on the LED screen 22.

Figure 4:
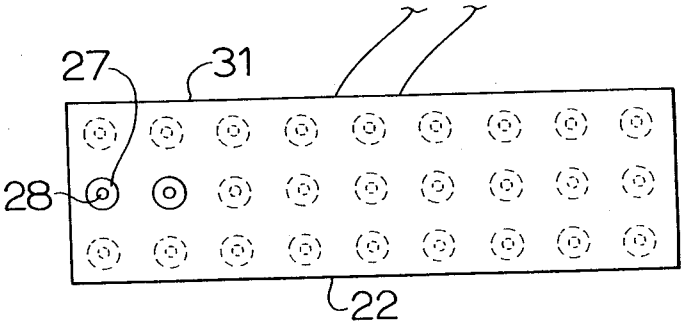
FIG. 4 is a front elevation of the display screen per se.
Figure 1:
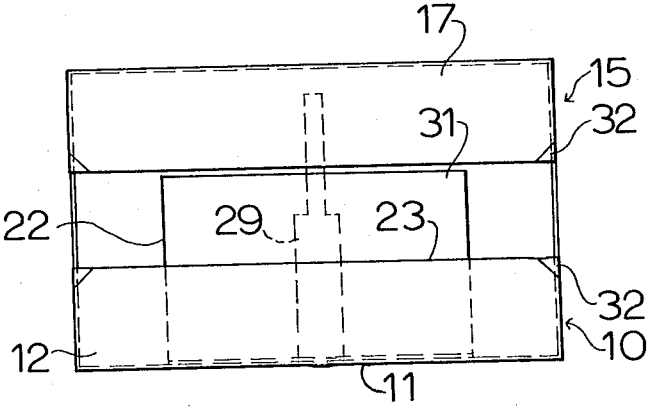
FIG. 1 is a front elevation of the device with the cover component shown in the open position.
Figure 2:
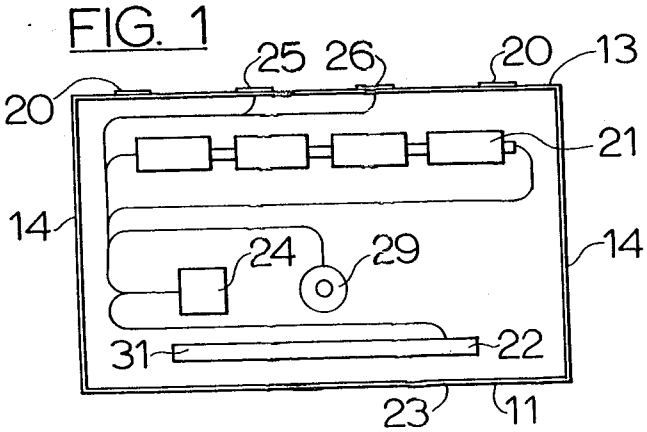
FIG. 2 is a plan view of FIG. 1 with the cover removed.

The control unit or central processing unit 24 generates and controls the display on the LED screen, said display comprising a pair of spaced apart circles of light 27 having an unilluminated centre spot 28 so that the pair of circles of light simulate a pair of eyes on the LED screen depending upon the predetermined program selected for the central processing unit or control unit 24, by means of switch 26. This pair of circles may be made to move in predetermined patterns across or upon screen 22. For example, if the pair of simulated eyes shown in full line in FIG. 4 of first illuminated, the left hand circle may be extinguished at the same time as the one immediately to the right of the other full line circle may illuminate and this may progress across the screen thus simulating the movement of a pair of eyes from one side of the screen to the other.

Alternatively, the pair of eyes may be illuminated in sequence so that it appears that the pair of eyes moves up and down. Alternatively a combination of these movements may be programmed.

One or both of the eyes may be programmed to extinguish momentarily thus simulating a wink or blink action of the pair of eyes.

Although the present embodiment contemplates a black screen with white circles 27 appearing thereon, nevertheless it will be appreciated that colors can be introduced by the choice of phosphors or other known means.

Means are provided to open and close the cover component 15. Normally the time that the cover remains open is preset but the actual opening sequence may be randomized within limits. One method of opening and closing of the cover component is illustrated by means of solenoid 29 mounted within the enclosure and projects into the cover component, said solenoid being operatively connected to the control unit 24. It will be noted from FIG. 3 that the solenoid is designed to extend an amount whereby the lower front edge 30 of the cover component is substantially level with the upper edge 31 of the screen so that when the cover component is in the open position, only the black screen is visible with the simulated eyes illuminated thereon.

In operation, the box is normally closed and is actuated by turning the on the control switch 25. The switch 26 is adjusted to give the desired randomized time delay and the preset pattern of movement of the simulated eyes.

The first switch 25 operatively connects the source of power such as battery 21 with the central processing unit 24, and, when selected by the unit 24, the solenoid 29 and the screen 22. By selecting different switch positions of switch 26, the control units 24 can be adjusted to operate within various time spans with some random value between upper and lower limits. Once the time actuates, the solenoid 29 extends thus lifting the cover component 15 and exposing the display screen 31. The simulated display eyes will move and either look ahead, or move from side to side, up or down, stopping, starting and looking around according to the pattern preselected by the switch 26. The movement of the simulated eyes should be set to a relatively natural movement of eyes scanning a room or a person therein.

After this predetermined movement sequence has been completed, the controller 24 will actuate solenoid 29 and close the cover component 15 with the spring loaded hinges 20 causing the cover to close relatively rapidly thus generating a sharp sound to draw attention to the device. In this connection, it may be desirable to provide metal corners 32 on the front of engaging corners of the cover component 15 and the enclosure 10.

As soon as the cover component is closed, the timing sequence again begins on a random basis thus leading to the next opening and operation of the device.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A novelty item comprising in combination an enclosure, a cover component hinged by one side thereof to the rear side of said enclosure, a source of an electrical power in said enclosure, and an electronic control unit within said enclosure operatively connected selectively to said source of electrical power, a display screen in said enclosure for displaying images thereon, and being operatively connected to said control unit, said display screen being situated adjacent the front side of said enclosure and extending into said cover component when same is in the closed position but being visible form the front of said enclosure when said cover component is in the open position, said images comprising a pair of spaced apart illuminated circles simulating a pair of eyes, and moveable across said screen in a predetermined pattern selected by said control unit, and means operatively connected to said control unit to open and close said cover component.

2. The novelty item according to claim 1 in which said enclosure includes a base, a front wall, a rear wall, and a pair of ends walls thereby forming a open top hollow enclosure, said cover component including a topped panel, a front wall, a rear wall, and a pair of ends walls thereby forming an open based hollow component to receive the major portion of said display screen when said cover component is in the closed position.

3. The novelty item according to claim 2 in which said cover component opens an amount whereby the lower edge of said front wall is substantially level with the upper edge of said display screen.

4. The novelty item according to claim 2 which includes control switch means operatively connected to said control unit whereby the timing of the opening and closing of said cover component may be selected within predetermined limits and movement of said simulated pair of eyes on said display screen may be selected from a plurality of predetermined patterns stored within said control unit.

5. The novelty item according to claim 4 which includes means in said control unit to extinguish momentarily, one or both of said simulated eyes thereby producing a winking or blinking action thereof.

6. The novelty item according to claim 1 which includes control switch means operatively connected to said control unit whereby the timing of the opening and closing of said cover component my be selected within predetermined limits and movement of said simulated pair of eyes on said display screen may be selected from a plurality of predetermined patterns stored within said control unit.

7. The novelty item according to claim 6 which includes means in said control unit to extinguish momentarily, one or both of said simulated eyes thereby producing a winking or blinking action thereof.

8. The novelty item according to claim 1 which includes means in said control unit to extinguish momentarily, one or both of said simulated eyes thereby producing a winking or blinking action thereof.

9. The novelty item according to claim 1 in which said lighted circles have a width greater than the unilluminated centre thereof.

* * * * *